US005129531A

United States Patent [19]

Beck et al.

[11] Patent Number: 5,129,531

[45] Date of Patent: Jul. 14, 1992

[54] CLOSURE ASSEMBLY WITH BREAKAWAY TAMPER EVIDENT MEMBRANE

[75] Inventors: James M. Beck, Carol Stream; Terry E. Kubitz, Cary, both of Ill.

[73] Assignee: Creative Packaging Corp., Wheeling, Ill.

[21] Appl. No.: 660,681

[22] Filed: Feb. 25, 1991

[51] Int. Cl.[5] ..... B65D 41/46

[52] U.S. Cl. ..... 215/256; 215/251; 215/254; 215/225; 220/257; 220/270; 220/276

[58] Field of Search ..... 215/250, 251, 254, 255, 215/256, 305, 224, 225; 220/251, 257, 270, 276

[56] References Cited

U.S. PATENT DOCUMENTS

| | | | |
|---|---|---|---|
| 3,465,910 | 9/1969 | Richie | 220/270 |
| 3,773,207 | 11/1973 | Dokoupil et al. | 220/270 |
| 4,106,653 | 8/1978 | Martinelli . | |
| 4,244,479 | 1/1981 | Smalley | 215/256 |
| 4,387,818 | 6/1983 | Conti | 215/256 |
| 4,487,329 | 12/1984 | Winstead | 220/276 |
| 4,602,718 | 7/1986 | Dutt | 215/252 |
| 4,651,885 | 3/1987 | Gach | 215/250 |
| 4,730,745 | 3/1988 | Perry | 215/230 |
| 4,784,279 | 11/1988 | Osting et al. . | |
| 4,830,208 | 5/1989 | Osting et al. . | |
| 4,961,512 | 10/1990 | Von Holdt | 220/270 |
| 4,966,292 | 10/1990 | Marino | 215/256 |
| 4,998,622 | 3/1991 | Drack | 220/270 X |

*Primary Examiner*—Stephen Marcus
*Assistant Examiner*—Vanessa Caretto
*Attorney, Agent, or Firm*—Silverman, Cass & Singer, Ltd.

[57] ABSTRACT

A closure assembly for a container including a cap and an engagement member for releasably connecting the cap to the container to cover an opening in the container with the cap. A tamper evident membrane surrounds the periphery of the cap and includes a connecting member for releasably joining the membrane about the periphery of the cap in a breakaway manner. A release tab is provided, integrally formed with the membrane, in a breakaway manner on a portion of the membrane. Release of the tab from the membrane enables the same to extend outwardly from the membrane so as to be grasped and pulled by a user to sever the connecting member and peel off the remaining portion of the tamper evident membrane to enable removal of the cap from the container.

5 Claims, 1 Drawing Sheet

Fig. 1
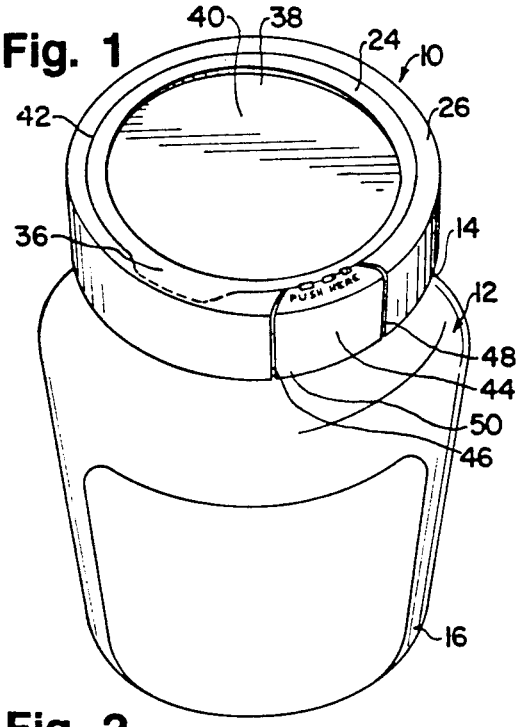
Fig. 2
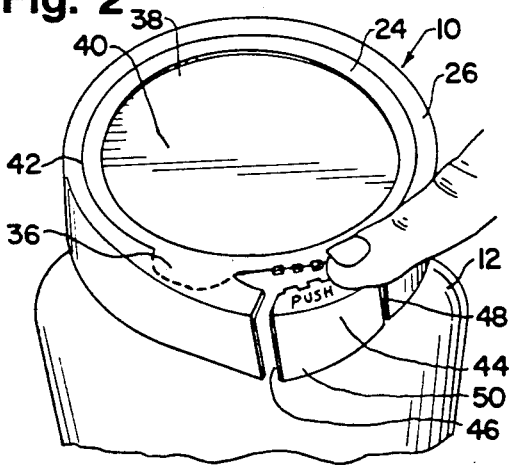
Fig. 3
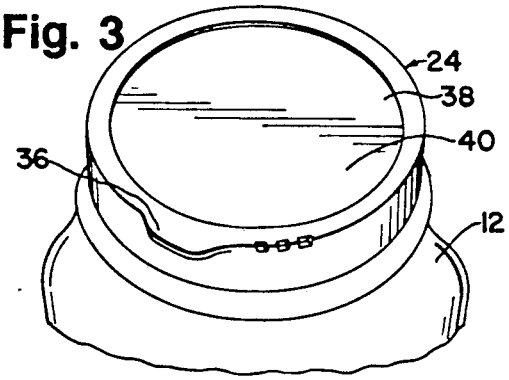
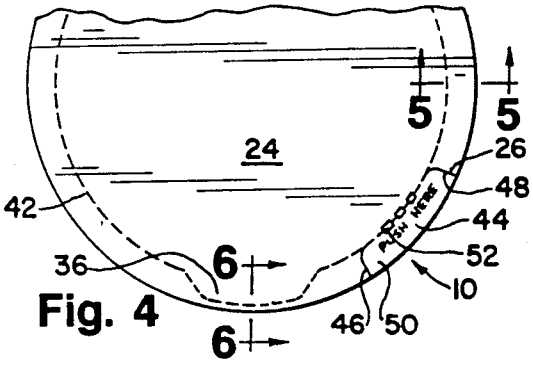
Fig. 4
Fig. 5
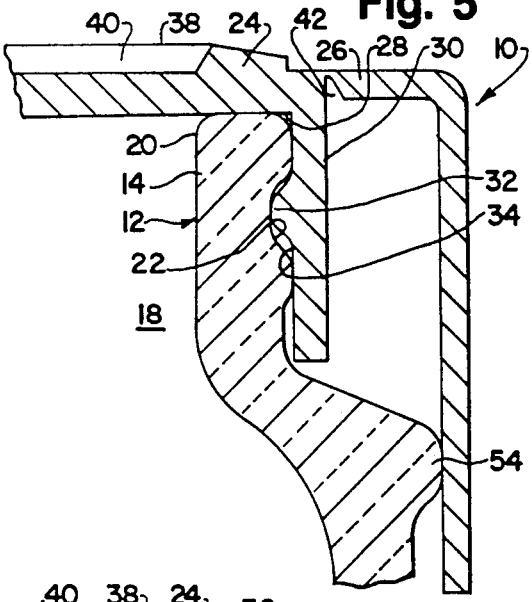
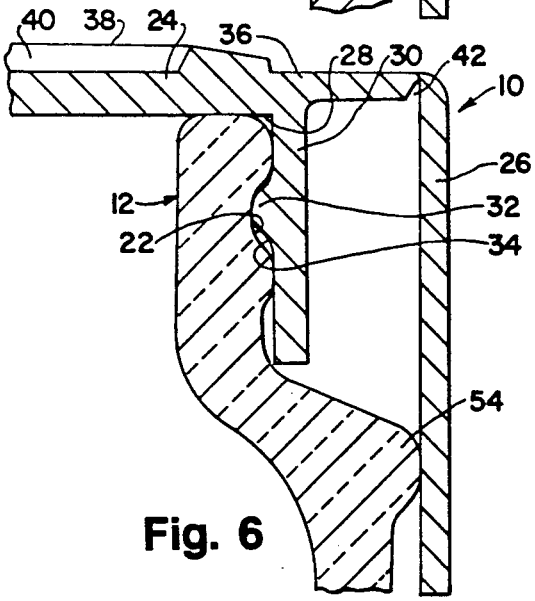
Fig. 6

CLOSURE ASSEMBLY WITH BREAKAWAY TAMPER EVIDENT MEMBRANE

BACKGROUND OF THE INVENTION

1. Field of the Invention

This invention relates generally to a closure assembly for a container, and more particularly, to such an assembly having a cap and a breakaway tamper evident membrane formed with the cap.

2. Description of the Prior Art

Closures or caps for containers typically are of the threaded screw or snap type construction and are utilized to seal the mouth of the container in either a resealable or non-resealable manner. In order to provide an indication to a consumer that the closure has been tampered with and the product within the container possibly tainted, various types of tamper evident members have been utilized in conjunction with such closures.

One type of tamper evident member for a container closure includes a removable plastic or metal band which is positioned about the periphery of the closure after it is affixed to the container, and typically spans the interstice between the closure and the container. Examples of such closures and bands are shown in U.S. Pat. Nos. 4,784,279 and 4,830,208. The bands of the type shown in such patents, however, typically are crimped, stretch fit or heat shrunk in place in an additional operation separate from affixing the closure to the container, and can be quite difficult to remove.

Closures also have been designed with an integrally formed tamper evident band extending therefrom. Such closures and bands, an example of which is shown in U.S. Pat. No. 4,106,653, typically are force fit over the mouth of the container and include a pull tab which can be grasped and pulled by a user to remove the band from the closure to enable removal of the closure from the container. Such pull tabs typically lie flat against the container and can be difficult to grasp. Furthermore, they provide an undesirable discontinuity in the shape of the closure and container which is not aesthetically pleasing and can provide packaging problems due to their odd shapes. Such pull tabs are not designed to extend outwardly from the closure and the container, because outward extension would subject the tabs to possible breakage during installation, shipping and handling.

It therefore is desirable to provide a closure assembly for a container having an end cap which includes a breakaway tamper evident membrane or band formed integrally therewith and in which the membrane includes a push release tab that, upon being pressed, releases outwardly from the closure assembly to enable the tab to be grasped and pulled by a user for removal of the remaining portion of the membrane. It also is desirable to provide such a closure assembly which, in its assembled position on the container, provides a continuous aesthetically pleasing profile and which is easy to install and closely resembles conventional end closures that do not include any type of tamper-evident membranes or bands.

SUMMARY OF THE INVENTION

The invention provides a closure assembly for a container which includes a breakaway tamper evident membrane. The assembly includes a cap having an engagement member for releasably connecting the cap to the container to cover an opening therein. A membrane surrounds the periphery of the cap and a connecting member releasably joins the membrane about the periphery of the cap in a breakaway manner. A push release tab member also is included which is integrally formed with the membrane in a breakaway manner on a portion of the membrane for push release of the tab from the membrane to force the same to extend outwardly from the membrane and thereby enable the tab to be grasped and pulled by a user to sever the connecting member and peel off the remaining portion of the membrane and thereby permit removal of the end cap from the container.

BRIEF DESCRIPTION OF THE DRAWING

FIG. 1 is a top perspective view of a container including the closure assembly of the invention connected thereto;

FIG. 2 is a fragmentary perspective view, similar to FIG. 1, illustrating a user's initial activation of the tab of the breakaway tamper evident membrane of the invention;

FIG. 3 is a fragmentary perspective view, similar to FIGS. 1 and 2, illustrating the container with the removable cap after removal of the breakaway tamper evident membrane;

FIG. 4 is a fragmentary top plan view of the closure assembly illustrated in FIG. 1;

FIG. 5 is an enlarged sectional view taken along the line 5—5 of FIG. 4, in the direction indicated generally; and FIG. 6 is an enlarged sectional view taken along the line 6—6 of FIG. 4, in the direction indicated generally.

DESCRIPTION OF THE PREFERRED EMBODIMENT

Referring to FIGS. 1 and 2, the closure assembly of the invention is designated generally by the reference numeral 10. The closure assembly 10 typically is utilized in conjunction with a container 12 as will be described in detail below.

The container 12 preferably is cylindrical in configuration and includes a top end 14 and a bottom end 16. As illustrated in FIG. 5, the container 12 forms an interior portion 18 and the top end 14 has an open mouth 20 which is covered and sealed by the closure assembly 10.

In order to releasably attach the closure assembly 10 to the container 12 during production and to permit opening and closing by a user, the outer perimeter of the top end 14 of container 12 can include an annular recess 22 which preferably is formed for snapping engagement with the closure assembly 10, as described below. However, the end 14 also can be designed for threaded screw engagement, if desired. It is to be understood that the shape, size and material of the container 12, as well as the size and shape of the open mouth 20 and recess 22, can vary.

The closure assembly 10 includes a cap 24 and a breakaway tamper evident membrane or band 26 formed about the periphery of the cap 24. As will be explained in detail below. Preferably, the assembly 10 is formed of plastic and the cap 24 is a snap on/off type of cap, but the cap can be a threaded screw-type cap, if desired. Additionally, to assist in sealing the cap 24 about the mouth 20 of the container 12, am underside 28 of the cap 24 can include a liner (not illustrated).

As FIGS. 5 and 6 illustrate, the underside 28 of the cap 24 preferably includes an integrally formed depending annular skirt or flange 30. The flange 30 includes an annular rib 32 formed on an interior side 34 of the flange 30. Preferably, the rib 32 cooperates to snap within the recess 22 of the container 12 to releasably attach the cap 24 and the closure assembly 10 to the container 12 during assembly and later use.

As explained briefly above, the rib 32 and corresponding recess 22 cooperate for attachment of the closure assembly 10 to the container 12 during initial production, and to permit resealing attachment of the cap 24 during use by a consumer. Further, if desired, the rib 32 and recess 22 can be formed as cooperating screw threads. To assist a consumer in removing the cap 24, the cap can include an outwardly extending lift tab 36 formed integrally with the cap 24 about a portion of the external perimeter or periphery of the cap 24.

To assist in stacking of similar containers 12 during shipping, storage and use, a top side 38 of the cap 24 can include a circular recess 40 formed therein. The circular recess 40 cooperates with the bottom end 16 of a like container 12 to provide the desired stacking ability.

The breakaway tamper evident band 26 is integrally formed about the external periphery of the cap 24 in a breakaway manner and has a predetermined width selected to span the interstice between the cap 24 and the container 12 when the assembly 10 is affixed to the container 12. Preferably, in order to provide the tamper evident breakaway capability of the band 26, a score line 42 is provided between the cap 24 and the band 26 along a substantially circular path on the bottom surface 28 of the cap 24. As FIG. 4 illustrates, the score line 42 can be formed as spaced indentations or perforations, if desired.

The substantially circular path of the score line 42 is disrupted in the vicinity of the lift tab 36 of the cap 24. Preferably, the score line 42 is selected to define the peripheral dimensions of the lift tab 36 which remains on the cap after removal of the band 26.

It is to be noted that the cap 24 and band 26 provide a closure assembly 10 which is of substantially continuous circular configuration and is generally aesthetically pleasing in appearance. Furthermore, the closure assembly 10 closely resembles a conventional closure that does not include any type of tamper evident member. Removal of the band 26 by anyone other than an authorized user will clearly indicate that the container 12 has been tampered with. The band is not replaceable after it has been removed.

As FIGS. 1, 2 and 4 illustrate, in order to assist a consumer in removing the band 26, a push release tab 44 is included about a portion of the band 26. The release tab 44 spans the width of the band 26 and is formed between a first readily severable score line 46 and a second score line 48. As FIG. 2 illustrates, in order to cause a first side 50 of the release tab 44 to extend outwardly from the band 26 and enable removal of the band 26, the first score line 46 preferably extends further into the band 26 than the second score line 48.

Thus, the band 26 readily can be broken or severed along the first score line 46 while the second score line 48 functions as a hinge member to keep the release tab 44 attached to the band 26 during removal. To further assist in severing the first side 50 of the release tab 44, the first score line 46 can be perforated, if desired.

The operation of the assembly is illustrated in, FIG. 2. Removal of the band 26 from the cap 24 is initiated by a user pushing downwardly. On the release tab 44. This downward force severs the first score line 46 on the first side 50 of the release tab 44. Thus, the first side 50 is free to extend outwardly from the band 26. In this position, the release tab 44 can be grasped by the user and pulled circumferentially outwardly to sever the band 26 from about the cap 24 along the circular score line 42 between the cap 24 and the band 26, including the portion of the circular score line 42 which extends about and defines the lift tab 26.

As FIG. 4 illustrates, to assist in severing the portion of the release tab 44 which is positioned along the circular score line 42, the circular score line 42 preferably is formed with perforations 52 along a portion thereof extending along the release tab 44. To further assist in removal of the release tab 44, the perforations 52 can be formed as enlarged through apertures, if desired.

As FIGS. 5 and 6 illustrate, the cooperation between the rib 32 on the cap 24 and the annular recess 22 on the container 12 provides the initial connection between the closure assembly 10 and the container 12. Additionally, the circumference of the band 26 is selected so that it fits snugly against the outside surface of the container 12. Preferably, a ridge 54 typically is included extending from the container 12 to assist in tight fitting of the band 26 thereagainst.

If desired, the circumference of the band 26 can be increased or decreased to vary the fit between the band 26 and the container 12 and/or ridge 54. Alternatively, the band 26 can be heat shrunk in place after the closure assembly 10 is connected to the container 12 to assist in the fit between the band 26 and the container 12, with or without the ridge 54.

To assemble the closure assembly 10 to the container 12, the closure assembly 10 first is positioned over the mouth 20 of the container 12 which typically is filled with a product. Thereafter, the closure assembly 10 is moved downwardly with a predetermined amount of force which enables the rib 32 on the flange 30 of the lid 24 to seat within the recess 22 of the container 12 while t he band 26 is snugly fit against the ridge 54 of the container 12.

To remove the closure assembly 10, the release tab 44 is pushed downwardly to sever the first score line 46 on the band 26. This enables the first side 50 of the release tab 44 to extend outwardly from the band 26 while the release tab 44 pivots outwardly about its second score line 48. In this position, the release tab 44 can be pulled by a user to sever the circular score line 42 about the entire periphery of the cap 24 and remove the band 26, which then can be discarded. Finally, the lift tab 36 is grasped by the user to provide an upward force to the cap 24 sufficient to displace the rib 32 on the cap 24 from the recess 22 in the container 12 and enable removal of the cap 24 providing access to the contents of the container 12.

Thereafter, the cap 24 can be placed back on the container 12 by a user without the band 26 by snapping the rib 32 back into the recess 22. The cap 24 can be removed and replaced repeatedly on the container 12 as often as desired.

Modifications and variations of the present invention are possible in light of the above teachings. A specific dimension, material, or construction is not required so long as the assembled device is able to function as herein described. It is therefore to be understood that within the scope of the appended claims, the invention may be practiced otherwise than as specifically described.

What is claimed and desired to be secured by letters patent of the United States is:

1. A closure assembly for a container, comprising:

a cap for covering an opening in the container, said cap having a first top side and a second bottom side, said second bottom side including an integrally formed depending flange extending therefrom a predetermined distance and said cap including a projecting lift tab on a portion of its periphery extending therefrom a predetermined distance and arranged substantially normal to said depending flange;

engagement means integral with said depending flange of said cap for releasably engaging said cap to the container to cover said opening in the container;

a band surrounding the periphery of said cap, said band having a predetermined thickness and width;

connecting means for releasably joining said band about the periphery of said cap and said lift tab in a breakaway manner; and a release tab integrally formed with said band, said release tab being formed between a first breakaway score line and a second non-breakaway score line, both said first and second score lines extending across said width of said band and at a predetermined distance from each other, said release tab being engageable by a user to sever said first breakaway score line and enable said release tab to extend away from said band to be grasped by the user and pulled thereby breaking said connecting means and removing said band from about the periphery of said cap, a top portion of said release tab being connected to said cap in a breakaway manner with perforations.

2. The assembly as defined in claim 1 wherein said engagement means provide a releaseable and resealable snap engagement between said cap and said container.

3. The assembly as defined in claim 1 wherein said cap, said depending flange and said band are of generally annular configuration.

4. The assembly as defined in claim 1 wherein said connecting means are formed by a score line.

5. The assembly as defined in claim 1 wherein said connecting means are formed by perforations.

* * * * *

UNITED STATES PATENT AND TRADEMARK OFFICE

CERTIFICATE OF CORRECTION

PATENT NO. : 5,129,531

DATED : July 14, 1992

INVENTOR(S) : James M. Beck and Terry E. Kubitz

It is certified that error appears in the above-identified patent and that said Letters Patent is hereby corrected as shown below:

Column 2, line 41, change "12 as" to --12, as--;

line 62, change "cap 24. As" to --cap 24, as--;

line 67, change "am" to --an--;

Column 4, line 4, change "downwardly. On" to --downwardly, on--;

line 41, change "t he" to --the--.

Signed and Sealed this

Seventeenth Day of August, 1993

Bruce Lehman

*Attest:*

BRUCE LEHMAN

*Attesting Officer*

*Commissioner of Patents and Trademarks*